US005224757A

United States Patent [19]

Geitz et al.

[11] Patent Number: 5,224,757

[45] Date of Patent: Jul. 6, 1993

[54] LUMBAR SUPPORT WAIST BAND AND MECHANISM THEREFOR

[75] Inventors: Manfred H. Geitz, Beaumont; Robert J. Hillyard, Happy Valley, both of Australia

[73] Assignee: Henderson's Federal Spring Works Pty. Ltd., Australia

[21] Appl. No.: 870,222

[22] Filed: Apr. 20, 1992

Related U.S. Application Data

[63] Continuation of Ser. No. 585,085, Feb. 26, 1990, filed as PCT/AU89/00137, Mar. 30, 1989, abandoned.

[30] Foreign Application Priority Data

Mar. 31, 1988 [AU] Australia ..... PI7540

[51] Int. Cl.[5] ..... A47C 3/00

[52] U.S. Cl. ..... 297/204.4; 297/284.2

[58] Field of Search ..... 297/284, 204-207, 297/284.4, 284.2

[56] References Cited

U.S. PATENT DOCUMENTS 4,565,406 1/1986 Suzuki ..... 297/284
4,709,961 12/1987 Hill ..... 297/284
4,715,653 12/1987 Hattori et al. ..... 297/284
4,886,316 12/1989 Suzayama et al. ..... 297/284

FOREIGN PATENT DOCUMENTS 2035792 6/1980 United Kingdom ..... 297/284
2059497 3/1981 United Kingdom ..... 297/284

*Primary Examiner*—Jose V. Chen
*Attorney, Agent, or Firm*—Banner, Birch, McKie & Beckett

[57] ABSTRACT

An adjustable bracket for a seat lumbar support is disclosed which includes a first bracket (38) adapted to be fixed on one side frame of the seat; a second bracket (20) adapted to be fixed to the other side frame of the seat, said bracket including a pivotally attached rocking member (23) adapted to be moved smoothly or stepwise through one or more intermediate positions between a first and second position by operation of adjustment means (28/29): said first bracket and said rocking member including attachment means (34) adapted to permanently or releasably engage with attachment means (48/49) on a waist band (41) adapted to extend between said first and second brackets.

10 Claims, 2 Drawing Sheets

LUMBAR SUPPORT WAIST BAND AND MECHANISM THEREFOR

This application is a continuation of application Ser. No. 07/585,085, filed Feb. 26, 1990, filed as PCT/AU89/00137, Mar. 30, 1989, now abandoned.

This invention relates to lumbar support apparatus and mechanism for seating and relates particularly but not exclusively to such apparatus and mechanisms for motor vehicle seating.

BACKGROUND OF THE INVENTION

Adjustable lumbar supports are provided in motor vehicles to provide for differing driver requirements and to increase driver or passenger comfort. Many adjustable lumbar supports are known and described in U.S. Pat. Nos. 3,948,558, 3,973,797, 4,462,635, 4,531,779, 4,534,592, 4,564,235, 4,630,865, 4,632,454 and 4,714,291 and in Australian patent or patent application Nos. 72822/81, 80449/82, 19524/83, 47090/85 (575427), 63973/86 and 72609/87.

One particular known support is described in Australian lapsed application No. 80449/82. The support comprises a "waist band" extending between two brackets fixed within and on either side of the frame of a vehicle seat. On one side of the seat frame, the waist band is pivotally attached to the bracket in a fixed position by way of a pivot pin. The pivot pin, which generally includes a nylon or other bush is fixed in pivotal arrangement by an appropriately formed plate which encircles the pivot pin and bush and terminates in two parallel spaced apart plates. The waist band is inserted between the plates and fixed by appropriate means such as riveting.

On the other side of the seat frame the waist band is again pivotally attached to a bracket in a manner similar to that described above. The bracket however includes adjustment means to reduce or increase the distance between the ends of the waist band to enable the required adjustable lumbar support. The adjustment is provided by forming the bracket in two parts which are hinged or pivotally fixed on the moveable part which acts as a cam follower. A cam which may be a continuous or stepped cam is operated by an appropriate handle attached to a spindle to permit the desired adjustment.

The known prior art lumbar supports are complicated and thus relatively expensive to manufacture. A lumbar support as is described in the above mentioned patent application requires many parts including the fixed bracket, pivot pin and bush, the waist band plate, the waist band, a further waist band place and associated pivot and bush, a two part bracket pivotably connected to permit appropriate adjustment all in addition to the cam, the cam drive spindle and handle.

In lumbar support devices as have been described above, the waist band may be a belt or belt like band of any suitable material. It is customary that waist bands are made of a stiff but flexible material such as a sheet of nylon, polypropylene polyethylene or the like. It is also customary that a pad of resilient foam is attached to one side of the waist band to provide additional cushioning to the lumbar region of the seat when fitted with such a device and waist band.

SUMMARY OF THE INVENTION

It is an object of this invention to provide a lumbar support apparatus and mechanism which avoids or reduces disadvantages of currently known and used lumbar support devices. It is an object of this invention to provide a lumbar support apparatus which utilizes fewer parts and which is thus cheaper and simpler to manufacture and assemble. It is also an object of this invention to provide a one piece waist band for a lumbar support apparatus which is simple to manufacture and install.

The present invention therefore provides in one preferred form an adjustable lumbar support for a seat having a first and second side frame disposed one on either side of the seat which support comprises:

- a first bracket adapted to be fixed to the first side frame of the seat;
- a second bracket adapted to be fixed to the second side frame of the seat, said bracket including a fixed bracket member and a rocking member pivotably attached by means of inter-engaging pivot members formed on said fixed bracket member and said rocking member;
- said pivotably attached rocking member being adapted to be moved smoothly or step wise through a number of intermediate positions between a first and second position by operation of adjustment means;
- said first bracket and said rocking member including attachment means adapted to permanently or releasably engage with attachment means on a waist band adapted to extend between said first and second brackets to provide adjustable lumbar support.

Preferably said adjustment means comprises cam means disposed within the second bracket and a cam following means integrally formed on the rocking member. Preferably the waist band is integrally formed in one piece with attachment means adapted to releasably engage with the attachment means of said first bracket and the attachment means on the rocking member of the second bracket.

The present invention also provides an adjustment bracket for a seat lumbar support which comprises:

- a fixed bracket member and a rocking member pivotably attached by means of inter-engaging pivot members formed on said fixed bracket member and said rocking member;
- said pivotably attached rocking member being adapted to be moved smoothly or step wise through a number of intermediate positions between a first and second position by operation of adjustment means; said rocking member including attachment means adapted to permanently or releasably engage with attachment means on a lumbar support waist band.

Preferably the locating means comprise upwardly extending tabs or lugs integrally formed on the rear section of the fixed bracket member section. Preferably the tabs or lugs also serve to hold the fixed bracket member section and the rocking member together when assembled. Preferably the holding of the

- bracket section and the rocking member is accomplished by deformation or bending of the tabs or lugs.

The invention in another form also provides an integrally moulded lumbar support

- a waist band having bracket attachment means at at least one end thereof. Preferably the bracket attachment means are adapted to releasably snap fit with a lumbar support bracket as hereinbefore or hereinafter described.

Preferably the waist band is integrally formed or moulded from a plastics material such as nylon, polypropylene, or polyethylene.

BRIEF DESCRIPTION OF THE DRAWINGS

In order that the invention may be more readily understood, preferred forms of the invention will now be described with reference to the accompanying drawings in which.

Figure 1:
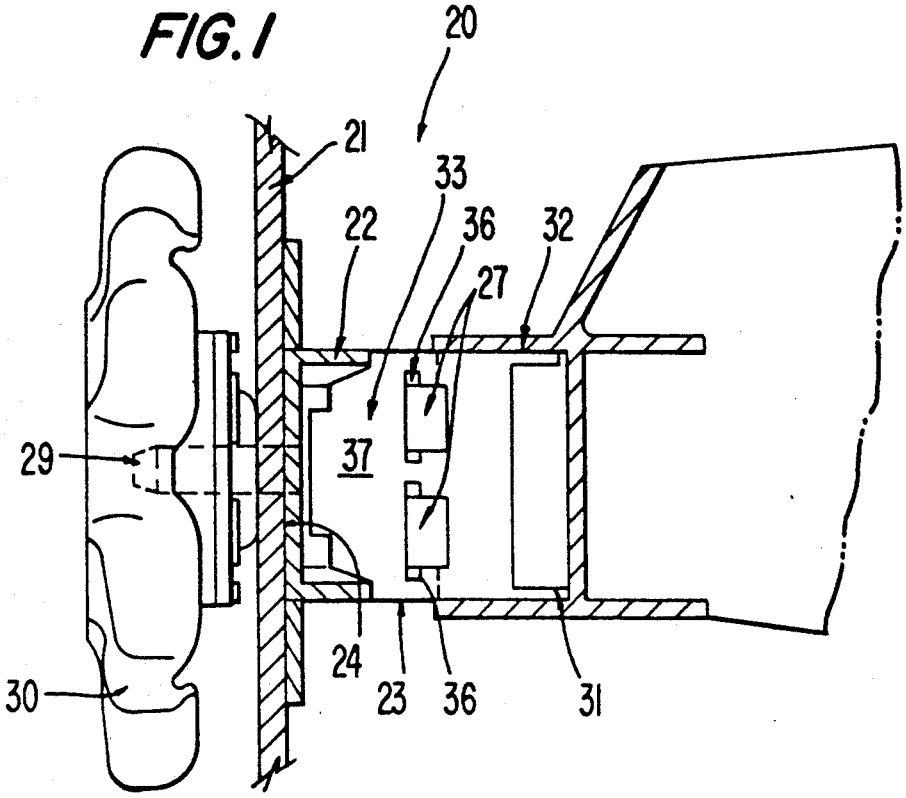
FIG. 1 is a partial "plan" view of one lumbar support apparatus constructed in accordance with the invention.
Figure 2:
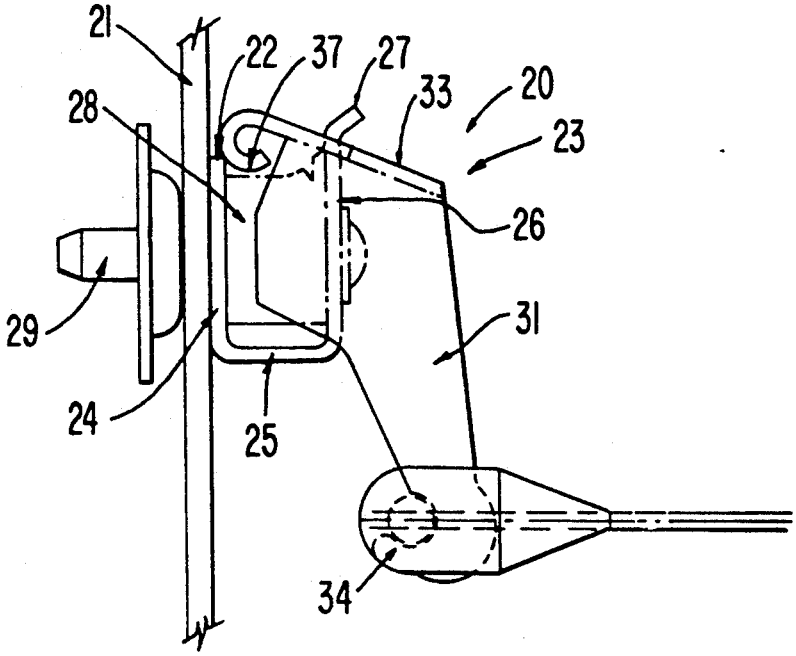
FIG. 2 is a side "view" of the apparatus of FIG. 1.

The terms "plan" and "side" view or elevation do not strictly refer to the apparatus in situ but refer to the apparatus as shown.

DETAILED DESCRIPTION OF THE PREFERRED EMBODIMENT OF THE INVENTION

Referring to the drawings there is shown an adjustable bracket 20 having a fixed member 22, for attachment (by means not shown) to seat side frame 21, and a rocking member 23. The fixed member 22 is formed in one piece from an appropriately dimensioned metal plate to form a substantially U-shaped (in cross section) member having a front plate section 24, a lower plate section 25 and a rear plate section 26. Rear plate section 26 includes two upwardly extending lugs 27, the purpose of which will become apparent. The space within the front, lower and rear plate sections is adapted to receive cam device 28 which is operated via cam spindle 29 and hand wheel 30.

The rocking member 23 is similarly formed in one piece from an appropriately dimensioned metal plate to form a further substantially U-shaped (in cross section) member having side 31, 32 and top plate 33 sections. Side plate sections 31, 32 include substantially parallel arms which extend downwardly and terminate with waist band engaging means 34 which comprise a greater than semi circular notch 35 disposed in the forward edge of each of the arms. The notch enables a releasable snap fit connection with the waist band as will be later described.

The top plate section 33 of the rocking member 23 includes two slots 36 adapted to receive and pivotally co-operate with the lugs 27 of the fixed member to enable pivotal movement of the rocking member 23 with respect to the fixed member 22 when the cam 28 is operated. The motion of the cam 28 translates to the rocking member by way of cam follower 37. The cam follower 37 is integrally formed as part of the rocking member 23 by forming a forwardly and downwardly projecting lug on the top plate section 33 of the rocking member 23 during its fabrication from metal plate as described above.

The lugs 27, following assembly of the bracket are bent rearwardly (or otherwise deformed) so that the fixed member and rocking member are permanently (in normal usage situations) connected together in a manner which enables limited pivotal or rocking motion between the fixed member 22 and the rocking member 23 as the cam and hand wheel is operated.

The cam, which may be a uniformly spirally increasing cam or a step wise increasing cam with a series of flat surfaces at increasing radial distances from the pivotal axis of the cam, when operated causes the rocking member to move forwardly and rearwardly and increase or decrease the distance between the bracket 20 fixed on one side frame of a seat and another bracket 38 (non adjustable) fixed on the opposite side frame of the seat. This motion in turn, as is well known, causes the waist belt to provide greater or lesser support in the lumbar region of the seat to which the device is attached.

Figure 3:
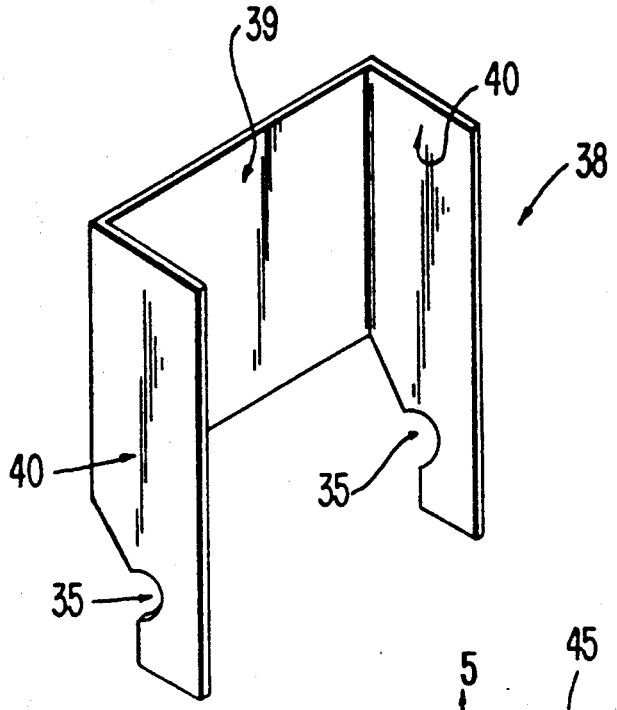
FIG. 3 is a perspective view of one first bracket in accordance with the invention.

Referring to FIG. 3 there is shown a simple fixed bracket for attachment (by means not shown) to the opposite side frame of a seat to the adjustable bracket described above. The bracket 38 is, as with previously described parts, formed in one piece from an appropriately shaped metal plate. The bracket 38 comprises a fixing plate 39 and two substantially parallel side plates 40. Again each of the side plates 40 include downwardly directed arms which terminate in notches 35 as described with respect to bracket 20. The notches again are disposed forwardly (that is to say disposed away from the corresponding bracket on the other side seat frame) to form lock means and enable snap fitting of a waist band appropriately dimensioned.

Figure 4:
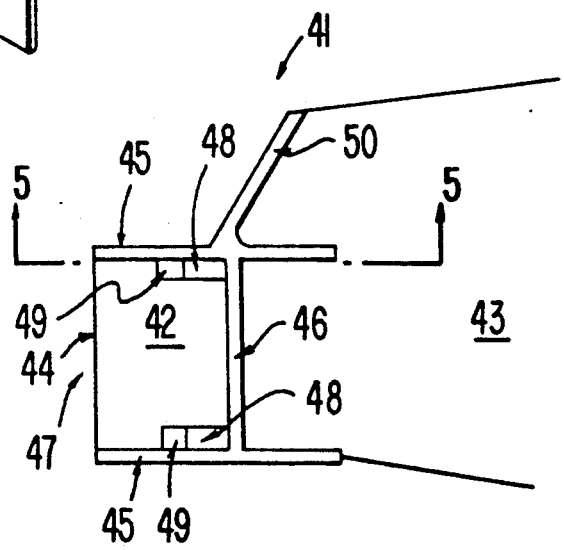
FIG. 4 is a plan view of the integrally formed fixing means on a waist band in accordance with another form of the invention.
Figure 5:
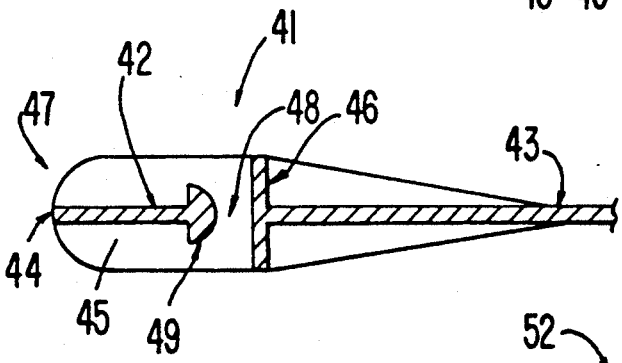
FIG. 5 is a cross sectional (5—5) view of the band of FIG. 4.

Referring to FIGS. 4 and 5 there is shown another preferred embodiment of this invention. The figures shown partially in plan and cross section, a preferred form of waist band 41 constructed in accordance with the invention. The waist band 41 has an integrally formed or moulded end portion 42 and belt section 43. The end portion 42 comprises an extension 44 of the belt section 43 and includes side flanges 45 and crosswise flange 46. The flanges 45 and 46 extend equally above and below the extension to support extension 44. The side flanges 45 extend from the end 47 of the extension 44 to the cross flange 46 and thereafter taper towards the belt portion 43. Slots 48 are provided in the end portion to accommodate the lock means of the bracket 20 or 38 which pass through the slots. Semi circular (cross section) lugs 49 are situated immediately forward of the slots to enable snap fit engagement with the brackets as previously described. If it is desired to provide a waist band having a greater width than the width between the side flange 45, an additional flange 50 may be provided to enable the width of the belt to be increased and suitably supported or strengthened.

Figure 6:
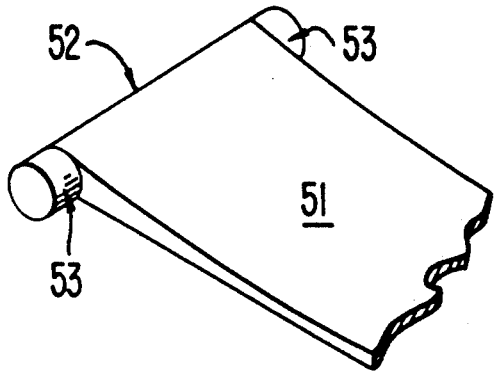
FIG. 6 is a perspective view of a further embodiment of waist band in accordance with the invention.

Referring to FIG. 6 there is shown a further embodiment of waist band end in accordance with the invention. The waist band 51 terminates in cylindrical end piece 52 having laterally extending lugs 53. The lugs 53 of substantially circular cross section are dimensioned to snap fit within e.g. notch 35 of bracket 20 or similar attachment lug means of bracket 38. The waist band is preferably formed by moulding in one piece from any suitable material such as hereinbefore described. The belt portion tapers from the end piece to assume the final desired thickness of band as required.

It will be readily apparent from the foregoing that many modifications may be made to the device(s) described without departing from the scope of the invention. It will be readily apparent also that the invention relates to an improved adjustable bracket for a seat lumbar support, to a remote drive mechanism therefor and to a new construction of integrally formed waist belt either individually and/or in combination.

We claim:

1. An adjustable lumbar support for a seat having first and second side frames disposed one on either side of the seat, said adjustable lumbar support comprising:

a first bracket attached to the first side frame of the seat;

a second bracket attached to the second side frame of the seat; and a flexible lumbar support waist band having two ends;

wherein said second bracket includes an integrally formed one-piece fixed bracket member of substantially U-shaped cross-section, an integrally formed one-piece rocking member of substantially U-shaped cross-section and a rocking member adjustment device, said integrally formed one-piece fixed bracket member and said integrally formed one-piece rocking member being pivotally attached to each other by means of inter-engaging members that are integral parts of said integrally formed one-piece fixed bracket member and said integrally formed one-piece rocking member, said inter-engaging members constituting the sole means by which said integrally formed one-piece fixed bracket member is attached to said integrally formed one-piece rocking member, said intergrally formed one-piece fixed bracket member having a front plate section, a lower plate section and a rear plate section forming said substantially U-shaped cross-section, said rear plate section including integrally formed therewith and upwardly extending therefrom at least one lug, said integrally formed one-piece rocking member having a first end and a second end and two side plate sections at least adjacent said second end and a top plate section at least adjacent said first end, said top plate section including at least one slot for reception of said lug, said slot and said lug constituting said inter-engaging members which provide for pivotal movement of said integrally formed one-piece rocking member with respect to said integrally formed one-piece fixed bracket member; said rocking member adjustment device being disposed between said front and rear plate sections and including a cam and cooperating cam follower, said cam follower being integrally formed on said top plate section spaced from said slot towards said first end of said integrally formed one-piece rocking member; said integrally formed one-piece rocking member being pivotable through a number of intermediate positions between first and second lumbar support positions by operation of said rocking member adjustment device; and said integrally formed one-piece rocking member having an engaging surface at said second end and said first bracket having an engaging surface, said ends of said flexible lumbar support waist band being attached one to each of the engaging surfaces of said first bracket and said integrally formed one-piece rocking member.

2. An adjustable lumbar support as claimed in claim 1 wherein said flexible lumbar support waist band is integrally formed in one piece.

3. An adjustable lumbar support for a seat having a first and a second side frame disposed one on either side of the seat, said adjustable lumbar support comprising a flexible lumbar support waist band fixed at a first end to the first side frame of the seat and fixed at a second end to a bracket attached to the second side frame of the seat, said bracket including an integrally formed one-piece fixed bracket member of substantially U-shaped cross-section, an integrally formed one-piece rocking member of substantially U-shaped cross-section and a rocking member adjustment device; said fixed bracket member and said rocking member being pivotally attached to each other solely by means of inter-engaging members that are integral parts of said fixed bracket member and said rocking member; said integrally formed one-piece fixed bracket member having a front plate section, a lower plate section and a rear plate section forming said substantially U-shaped cross-section, said rear plate section having at least one integrally formed and upwardly extending lug, said integrally formed one-piece rocking member having two side plate sections and a top plate section, said top plate section having at least one slot for reception of said lug of said integrally formed one-piece fixed bracket member to provide for pivotal movement of said integrally formed one-piece rocking member with respect to said integrally formed one-piece fixed bracket member; said rocking member adjustment device being disposed between said front and rear plate sections of said integrally formed one-piece fixed bracket member and including a cam and cooperating cam follower integrally formed on the top plate section of the rocking member spaced from said slot; said integrally formed one-piece rocking member being caused to pivot through a number of intermediate positions between first and second lumbar support positions by operation of said rocking member adjustment device; said integrally formed one-piece rocking member including an engaging surface for attaching the second end of the flexible lumbar support waist band to said bracket.

4. A lumbar support as claimed in claim 3 in which the waist band is integrally formed in one piece.

5. An adjustable lumbar support for a seat having a first and a second side frame disposed one on either side of said seat, said adjustable lumbar support comprising:

a first bracket attached to said first side frame of said seat;

a second bracket attached to said second side frame of said seat; and a flexible lumbar support waist band having two ends;

wherein said second bracket includes an integrally formed one-piece fixed bracket, an integrally formed one-piece rocking member and a rocking member adjustment device, said integrally formed one-piece fixed bracket member and said integrally formed one-piece rocking member being pivotally attached to each other by inter-engaging members that are integral parts of said integrally formed one-piece fixed bracket and said integrally formed one-piece rocking member, said inter-engaging members constituting the sole means by which said integrally formed one-piece fixed bracket member is attached to said integrally formed one-piece rocking member; said integrally formed one-piece rocking member being pivotable through a number of intermediate positions between first and second lumbar support positions by operation of said rocking member adjustment device which is attached to said integrally formed one-piece fixed bracket; and said integrally formed one-piece rocking member and said first bracket including engaging surfaces for attaching said ends of said flexible lumbar support waist band to said first and second brackets such that said flexible lumbar support waist band extends therebetween.

6. An adjustable lumbar support as claimed in claim 5 wherein said flexible lumbar support waist band is integrally formed in one piece.

7. An adjustable lumbar support as claimed in claim 6 wherein said flexible lumbar support waist band is of a synthetic plastics material.

8. An adjustable lumbar support for a seat having first and second side frames disposed one on either side of the seat, said adjustable lumbar support comprising:

a flexible lumbar support waist band having two ends;

a bracket attached to said second side frame of said seat, said bracket having a fixed bracket member, a rocking member and a rocking member adjustment device, said fixed bracket member and said rocking member being pivotally attached to each other by inter-engaging members that are integral parts of said rocking member and said fixed bracket member, said interengaging members constituting the sole means by which said rocking member and said fixed bracket member are pivotally attached to each other, said rocking member being pivotable through a number of intermediate positions between first and second lumbar support positions by operation of said rocking member adjustment device; said first side frame and said rocking member including engagement surfaces for attachment of said ends of said flexible lumbar support waist band such that said flexible lumbar support waist band extends between said first side frame and said bracket.

9. An adjustable lumbar support as claimed in claim 8 wherein said flexible lumbar support waist band is integrally formed in one piece.

10. An adjustable lumbar support as claimed in claim 9 wherein said flexible lumbar support waist band is of a synthetic plastics material.

* * * * *